US012479652B2

(12) United States Patent
Li et al.

(10) Patent No.: US 12,479,652 B2
(45) Date of Patent: Nov. 25, 2025

(54) STORAGE TANK INNER WALL AND FLOATING DISC TOTALLY ENCLOSED APPARATUS

(71) Applicant: HEBEI EVEREST INSTRUMENT EQUIPMENT CO. , LTD, Handan (CN)

(72) Inventors: Botao Li, Handan (CN); Jingyan Li, Handan (CN); Zhixue Wang, Handan (CN)

(73) Assignee: HEBE EVEREST INSTRUMENT EQUIPMENT CO., LTD, Handan (CN)

( * ) Notice: Subject to any disclaimer, the term of this patent is extended or adjusted under 35 U.S.C. 154(b) by 15 days.

(21) Appl. No.: 18/611,733

(22) Filed: Mar. 21, 2024

(65) Prior Publication Data

US 2024/0262613 A1 Aug. 8, 2024

Related U.S. Application Data

(63) Continuation of application No. PCT/CN2023/077524, filed on Feb. 22, 2023.

(30) Foreign Application Priority Data

Dec. 20, 2022 (CN) ..... 202211640572.7

(51) Int. Cl.
*B65D 88/42* (2006.01)

(52) U.S. Cl.
CPC ..... *B65D 88/42* (2013.01)

(58) Field of Classification Search
CPC ..... B65D 83/44; B65D 88/38; B65D 81/245; B65D 88/42; B65D 88/34; B65D 88/46; B65D 90/00; B65D 90/30; B65D 90/32
See application file for complete search history.

(56) References Cited

U.S. PATENT DOCUMENTS 4,254,887 A * 3/1981 Bold ..... B65D 90/38 220/225
4,413,747 A * 11/1983 Tenold ..... B65D 88/34 220/225

(Continued)

FOREIGN PATENT DOCUMENTS

CA 1307895 C 9/1992
CN 204297427 U 4/2015

(Continued)

*Primary Examiner* — Kareen K Thomas
(74) *Attorney, Agent, or Firm* — Tutunjian & Bitetto, P.C.

(57) ABSTRACT

A storage tank inner wall and floating disc totally enclosed apparatus includes a tank body, floating disc, pressure relief balance structure and a flexible sealing body structure, wherein the floating disc is arranged in the tank body, the edge of the floating disc is provided with an outer frame, the outer frame is provided with a plurality of sealing structures, the top of the inner wall of the tank body is provided with an annular support, one end of the flexible sealing body structure is fixedly connected with the annular support, the other end of the flexible sealing body structure is fixedly connected with the outer frame, one end of the pressure relief balance structure is sequentially and fixedly connected with the flexible sealing body structure and the annular support, and the joint of the annular support is provided with a through hole.

9 Claims, 6 Drawing Sheets

(56) References Cited

U.S. PATENT DOCUMENTS

| | | | | | |
|---|---|---|---|---|---|
| 4,552,090 | A * | 11/1985 | Coleman | B65D 90/48 | 220/222 |
| 4,625,886 | A * | 12/1986 | Eisenman | B44D 3/00 | 220/267 |
| 5,002,196 | A * | 3/1991 | Bassili | A63B 39/025 | 220/240 |
| 5,004,118 | A * | 4/1991 | England | B44D 3/127 | 220/521 |
| 5,005,724 | A * | 4/1991 | Imhof | B65D 88/42 | 220/222 |
| 5,249,692 | A * | 10/1993 | Gunderson | B65D 81/245 | 383/121.1 |
| 6,125,736 | A * | 10/2000 | Marin | C12G 1/02 | 435/813 |
| 2014/0027455 | A1* | 1/2014 | Castellano | B65D 90/0093 | 134/22.1 |

FOREIGN PATENT DOCUMENTS

| | | | |
|---|---|---|---|
| CN | 105460446 | A | 4/2016 |
| CN | 107215581 | A | 9/2017 |
| CN | 207107457 | U | 3/2018 |
| CN | 108861150 | A | 11/2018 |
| CN | 110451102 | A | 11/2019 |
| CN | 110871968 | A | 3/2020 |
| CN | 210285386 | U | 4/2020 |
| CN | 210708861 | U | 6/2020 |
| CN | 213058484 | U | 4/2021 |
| CN | 216735706 | U | 6/2022 |
| EP | 0080130 | A1 | 6/1983 |
| EP | 0781715 | A1 | 7/1997 |
| JP | 2004352355 | A | 12/2004 |

* cited by examiner

A

STORAGE TANK INNER WALL AND FLOATING DISC TOTALLY ENCLOSED APPARATUS

CROSS REFERENCE TO RELATED APPLICATIONS

This application is a continuation application of International Application No. PCT/CN2023/077524, filed on Feb. 22, 2023, which is based upon and claims foreign priority to Chinese patent application Ser. No. 202211640572.7, filed on Dec. 20, 2022, the entire contents of which are incorporated herein by reference.

TECHNICAL FIELD

The present invention belongs to the technical field of tank body sealing, and particularly relates to a storage tank inner wall and floating disc totally enclosed apparatus.

BACKGROUND

At present, a primary sealing apparatus for sealing a storage tank has sealing forms such as mechanical sealing, soft foam sealing and tubular sealing, and the storage tank is arranged at a gap between an outer floating roof and a tank wall in a primary sealing mode, which can ensure that sealing is formed when the gap between the floating roof and the tank wall changes in the running process of the floating roof and oil gas leaked from a movement gap between the floating roof is closed.

However, as parts can have deformation and manufacturing errors in the manufacturing process, existing seals (such as large compensation seal, tongue type seal, and bag type seal) are arranged on the outer edge of the floating roof, most of oil gas is closed in the installation process due to assembly errors and the movement gap in the movement process of a floating disc, but part of oil gas still leaks and is discharged from a pressure relief valve at the top of a tank body during pressure relief, so that the leakage of VOCs exceeds the standard. The largest leakage point is between the inner wall of the tank body and the floating roof seal movement gap. The prior art can not solve the problems that toxic, harmful and combustible gas volatilization exceeds the standard.

Therefore, how to provide a storage tank inner wall and floating disc totally enclosed apparatus becomes a problem to be solved by those skilled in the art.

SUMMARY

In view of this, the present invention provides a storage tank inner wall and floating disc totally enclosed apparatus. Aiming at the leakage of toxic, harmful and combustible gases between the inner wall of a closed tank body and a sealed movement gap of a floating roof, the inner wall of a storage tank and a floating disc are totally enclosed by flexible materials, such that it is ensured that volatile gases in the storage tank are prevented from leaking, and the environmental protection and safety requirements are met.

In order to achieve the objective, the present invention adopts the following technical solution: a storage tank inner wall and floating disc totally enclosed apparatus includes a tank body, a floating disc, a pressure relief balance structure and a flexible sealing body structure, wherein the floating disc is arranged in the tank body, an edge of the floating disc is provided with an outer frame, the outer frame is provided with a plurality of sealing structures, a top of an inner wall of the tank body is provided with an annular support, the annular support has a cross section in a right-angled-n shape and a hollowed-out bottom, one end of the flexible sealing body structure is fixedly connected with the annular support, the other end of the flexible sealing body structure is fixedly connected with the outer frame, one end of the pressure relief balance structure is sequentially and fixedly connected with the flexible sealing body structure and the annular support, a joint of the annular support is provided with a through hole, the pressure relief balance structure is communicated with the annular support, the other end of the pressure relief balance structure is fixedly connected with the outer frame, the outer frame is correspondingly provided with an exhaust hole, and the exhaust hole is arranged below the plurality of sealing structures.

Further, the flexible sealing body structure includes a flexible sealing body, a flexible sealing body upper pressure plate, a flexible sealing body lower pressure plate and pressure plate screws, the flexible sealing body encircles in a barrel shape in a storage tank, upper and lower edge parts of the flexible sealing body are provided with fixed hole sites, the flexible sealing body upper pressure plate is arranged at an upper end of the flexible sealing body in a covering mode, the flexible sealing body upper pressure plate is fixed on the annular support through a pressure plate screw, the flexible sealing body lower pressure plate is arranged at a fixed position of a lower end of the flexible sealing body, and the flexible sealing body lower pressure plate is fixed on an upper surface of the floating disc through pressure plate screws.

Further, front and back surfaces of upper and lower fixed positions of the flexible sealing body are coated with sealants or additionally provided with sealing strips.

Further, the pressure relief balance structure includes an upper pressure relief pipe L joint, a pressure relief corrugated pipe, a lower pressure relief pipe L joint and pressure relief pipe fixing clamps, the upper pressure relief pipe L joint is fixed on a side plate of the annular support, the upper pressure relief pipe L joint is communicated with the through hole, the lower pressure relief pipe L joint is fixed on the outer frame and communicated with the exhaust hole, and the upper pressure relief pipe L joint and the lower pressure relief pipe L joint are communicated with the pressure relief corrugated pipe through the pressure relief pipe fixing clamps.

Further, the apparatus further includes a sealing gasket, and the sealing gasket is arranged between the annular support and the inner wall of the tank body.

Further, the plurality of sealing structures include a tongue type seal and a large compensation mechanical seal, the tongue type seal and the large compensation mechanical seal are both arranged on the outer frame of the floating disc, the tongue type seal is arranged above the large compensation mechanical seal, and the tongue type seal and the large compensation mechanical seal both abut against the inner wall of the tank body.

Further, the apparatus further includes an elastic arc plate, an upper portion of the elastic arc plate is bent, a curvature of the elastic arc plate is the same as that of an arc surface inside the tank body, the elastic arc plate is located between the inner wall of the tank body and the flexible sealing body, the elastic arc plate is fixed on the outer frame of the floating disc, and the elastic arc plate abuts against the inner wall of the tank body.

Further, the apparatus further includes a guide stand column, one end of the guide stand column is arranged at a bottom of the tank body, the other end of the guide stand column penetrates through the floating disc and is fixed at a top of the tank body, and the guide stand column is in sliding and sealing contact with the floating disc.

Further, inner support legs are arranged at a bottom end face of the floating disc.

The beneficial effects of the present invention are as follows:

The storage tank inner wall and floating disc totally enclosed apparatus of the present invention utilizes the flexible sealing body of the inner wall of the tank body to close the space between the edge seal of the floating disc and the inner wall of the tank body, so that when volatile substances leak due to the up-and-down motion between the floating disc seal and the tank wall and the floating disc floats up and down, a large amount of volatile liquid remained on the tank wall is closed in the flexible sealing body of the inner wall of the tank body, conversion from the dynamic sealing to the static sealing is realized, when the pressure can be increased along with the time and the motion, pressure oil gas returns the volatile gas into the tank body through the corrugated pipe of the pressure relief balance structure, the content of VOCs volatile substances in the tank body is controlled to the maximum extent, the utility of a floating roof facility is fully exerted, the discharge of VOCs reaches the standard, the standard requirement of safety and environmental protection is met, the arrangement of the elastic arc plate can avoid the damage of the flexible sealing body due to accumulation, and the effectiveness of the sealing apparatus is ensured.

Figure 1:
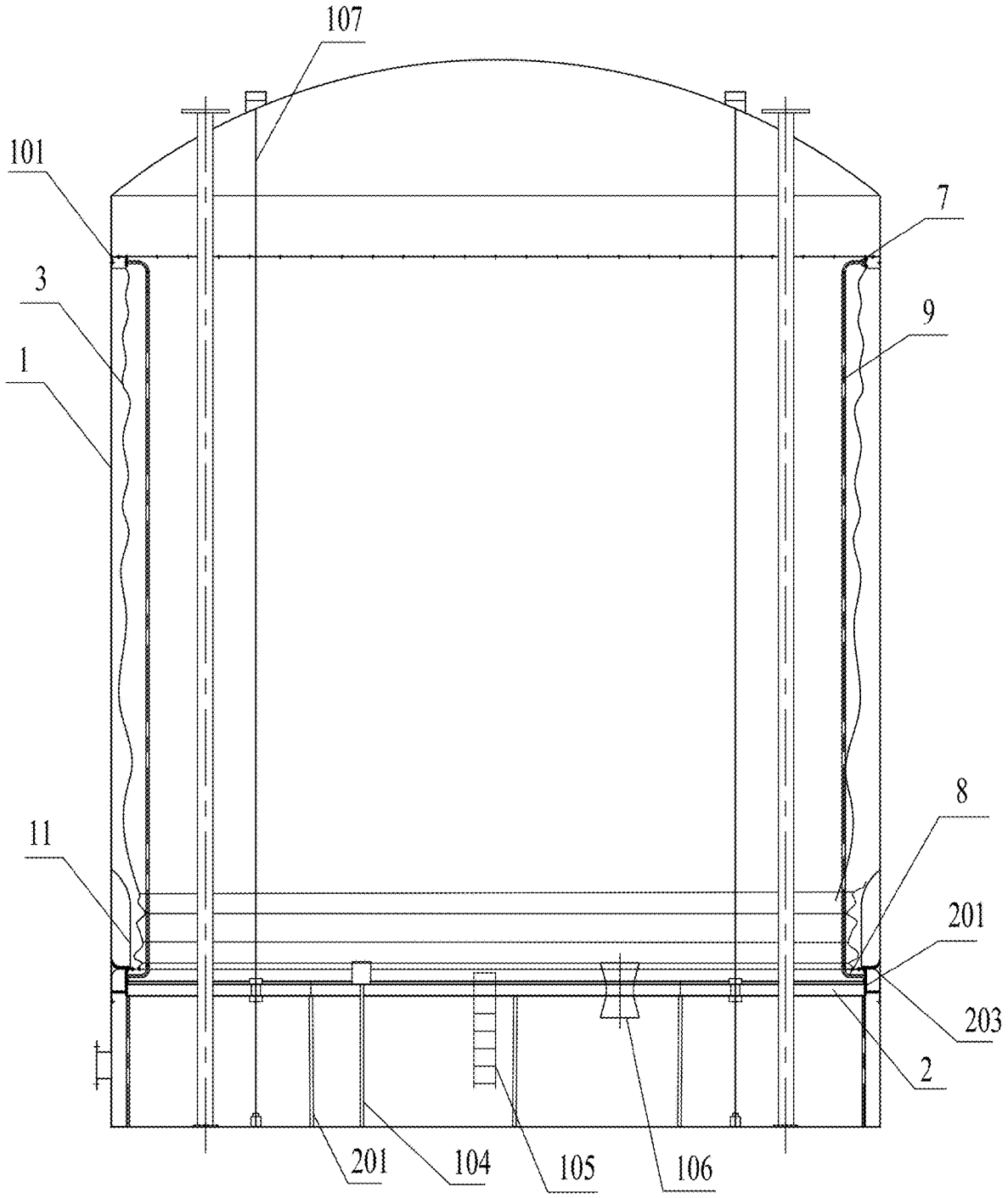
FIG. 1 is a schematic structural diagram according to the present invention.
Figure 2:
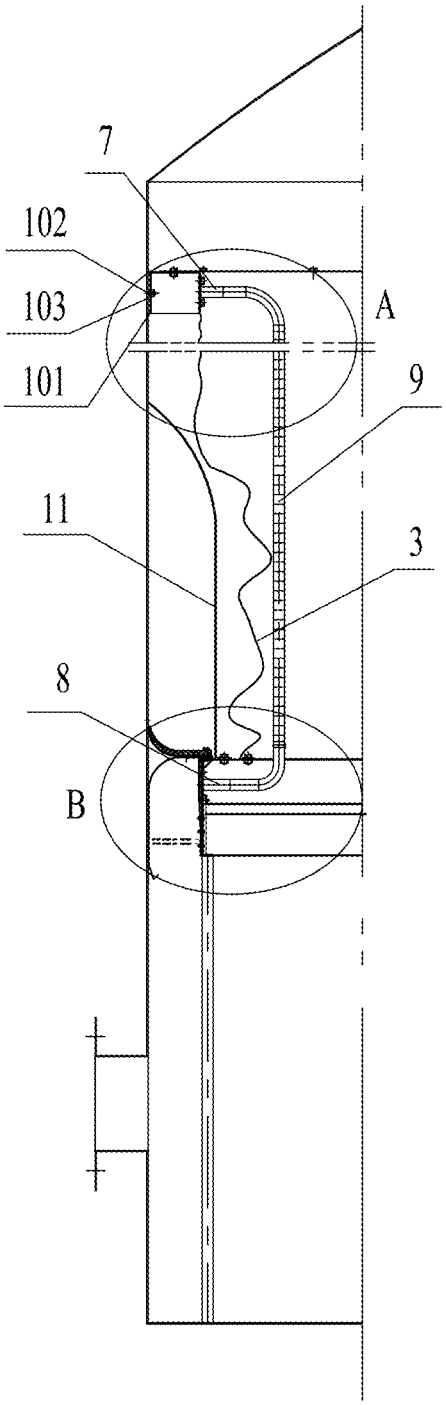
FIG. 2 is a schematic diagram of flexible sealing body installation and pressure relief balance corrugated pipe installation according to the present invention.
Figure 3:
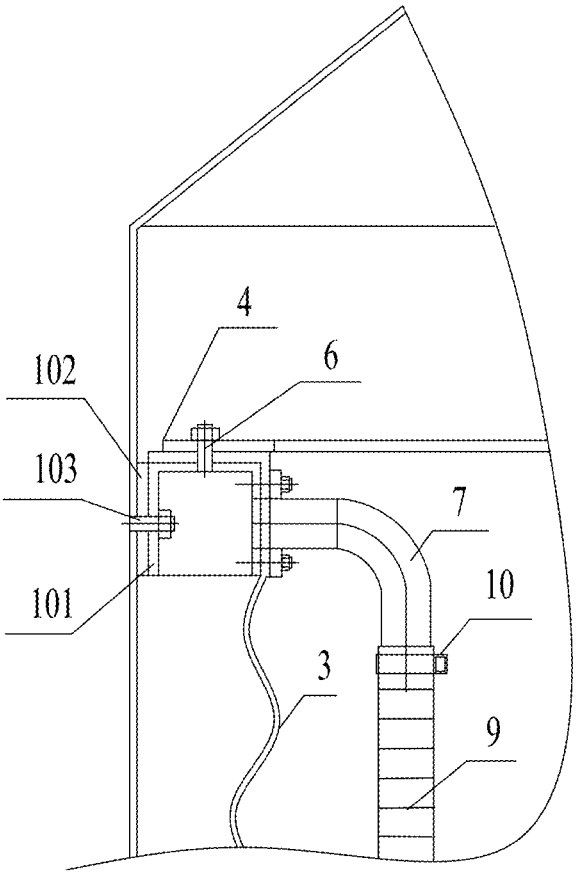
FIG. 3 is a partial enlarged view of a portion A in FIG. 2.
Figure 4:
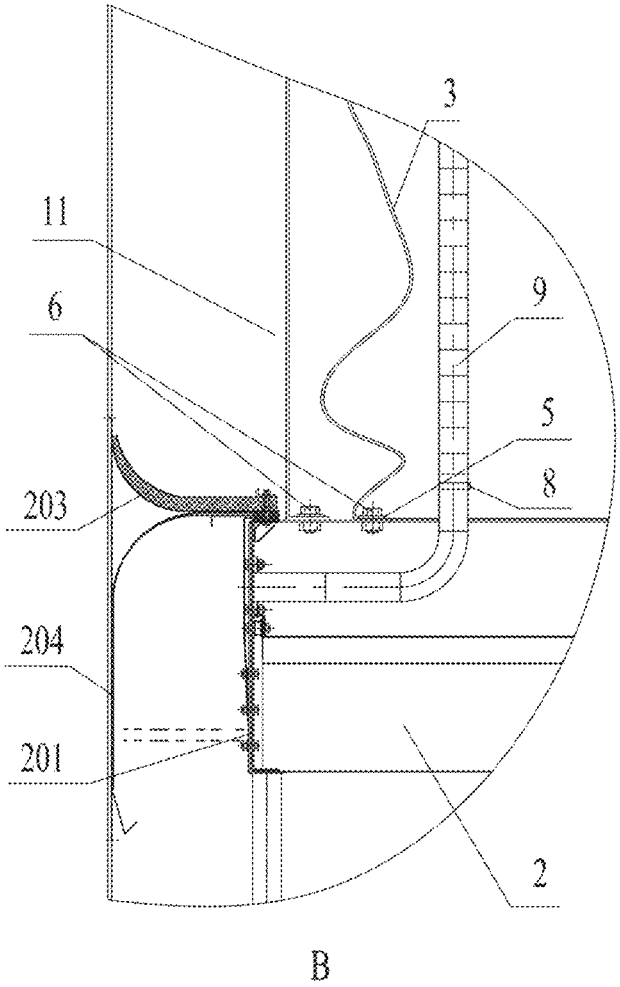
FIG. 4 is a partial enlarged view of a portion B in FIG. 2.
Figure 5:
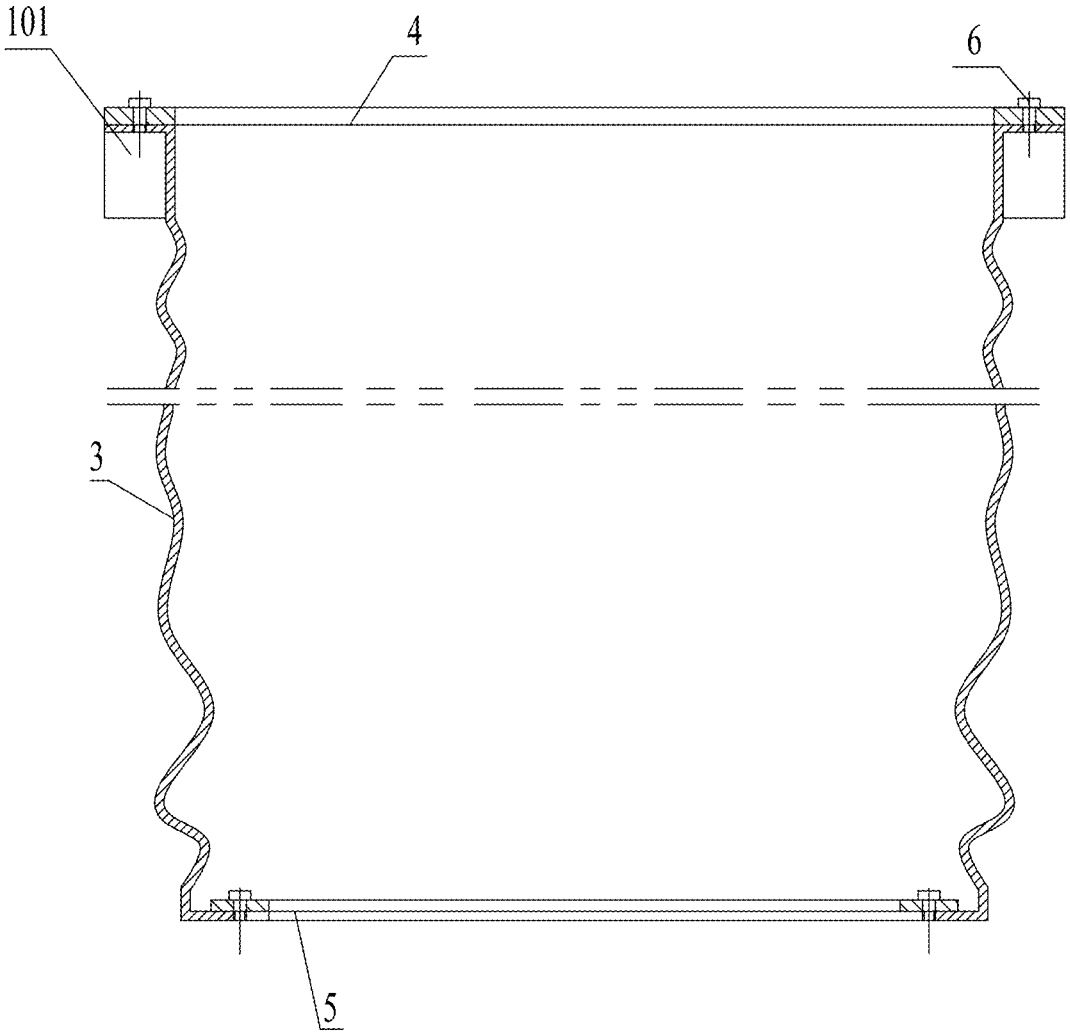
FIG. 5 is a schematic diagram of a flexible sealing assembly in a tank according to the present invention.
Figure 6:
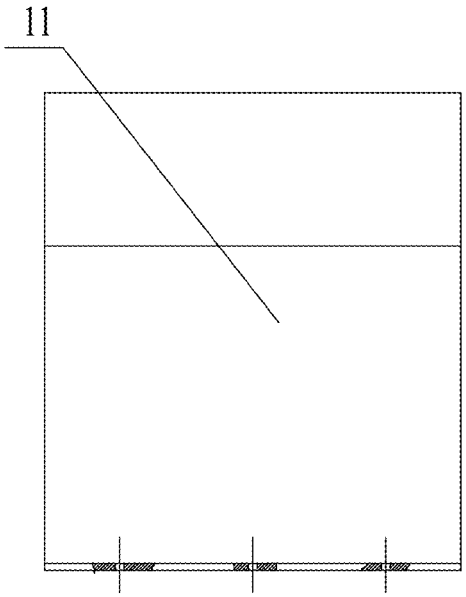
FIG. 6 is a front view of an elastic arc plate according to the present invention.
Figure 7:
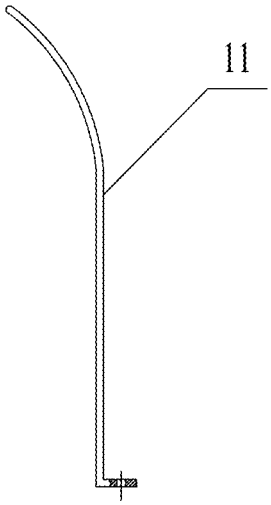
FIG. 7 is a side view of an elastic arc plate according to the present invention.

In the figures: 1. tank body; 101. annular support; 102. single-ended screw; 103. sealing gasket; 104. manhole; 105. oil metering hole; 106. detecting hole; 107. guide stand column; 2. floating disc; 201. outer frame, 202. inner support leg; 203. tongue type seal; 204. large compensation mechanical seal; 3. flexible sealing body; 4. flexible sealing body upper pressure plate; 5. flexible sealing body lower pressure plate; 6. pressure plate screw; 7. upper pressure relief pipe L joint; 8. lower pressure relief pipe L joint; 9. pressure relief corrugated pipe; 10. pressure relief pipe fixing clamp; and 11. elastic arc plate.

DETAILED DESCRIPTION OF THE EMBODIMENTS

The technical solutions in the embodiments of the present invention will be clearly and completely described below with reference to the drawings in the embodiments of the present invention.

In the description of the present invention, it should be noted that the terms "center", "upper", "lower", "left", "right", "horizontal", "inner", "outer", "one side", and the like indicate orientations or positional relationships based on the orientations or positional relationships shown in the drawings, only for convenience of description and simplification of description, but do not indicate or imply that the device or element referred to must have a specific orientation, be constructed and operated in a specific orientation, and thus, should not be construed as limiting the present invention; the terms "first," "second," and "third" are used for descriptive purposes only and are not to be construed as indicating or implying relative importance, and furthermore, unless otherwise explicitly stated or limited, the terms "installed," "connected," and "connection" are to be construed broadly and may be, for example, fixedly connected, detachably connected, or integrally connected; may be mechanically or electrically connected; they may be connected directly or indirectly through intervening media, or they may be interconnected between two elements. For those of ordinary skill in the art, the specific meanings of the aforementioned terms in the present invention can be understood according to specific conditions.

Embodiment 1

The present invention provides a storage tank inner wall and floating disc totally enclosed apparatus, which includes a tank body 1, a floating disc 2, a pressure relief balance structure and a flexible sealing body structure, wherein the floating disc 2 floats above hydraulic oil gas in the tank body, and the bottom of the tank body 1 is provided with a manhole 104 with a sealing cover, an oil metering hole 105 and a detecting hole 106.

An annular support 101 is welded and fixed on the inner wall of the tank body 1 through a single-ended screw 102 radially and uniformly arranged along the upper portion of the tank body 1, a sealing gasket 103 is arranged between the annular support 101 and the inner wall of the tank body 1, and the annular support 101 is a frame type structure with a hollowed-out bottom. Specifically, the annular support 101 includes a plurality of sections of parts, and the position that links up between sections needs to be coated with anticorrosive colloid for sealing and solidification. The single-ended screw 102 is fixed in a mode: firstly, a through hole is uniformly and radially arranged on the tank body 1, one end of the single-ended screw 102 is loaded into the hole, then the welding is uniformly distributed along the circumference of the screw inside the tank wall, no air hole exists, and the levelness of a slag hole and a screw central shaft radially arranged is not more than 0.5 mm.

The flexible sealing body structure includes a flexible sealing body 3, a flexible sealing body upper pressure plate 4, a flexible sealing body lower pressure plate 5 and pressure plate screws 6, and the flexible sealing body 3 encircles in a barrel shape in the tank body 1. The flexible sealing body 3 in the present embodiment is one kind of cloth material that has chemical corrosion resistance, pressure resistance, high temperature resistance, fire resistance, and flexibility. Specifically, the flexible sealing body 3 is fire prevention cloth, and can automatically contract along with in-out changes of volume of media in the media in-out process of the tank body 1. The integral flexible sealing body 3 is made of a plurality of split flexible sealing body materials, left cloth and right cloth are gradually folded after being spliced, and zippers are installed at the folded edge parts for closing.

The upper and lower edge parts of the flexible sealing body 3 are provided with fixed hole sites, the flexible sealing body upper pressure plate 4 is arranged at an upper end of the flexible sealing body 3 in a covering mode, the flexible sealing body upper pressure plate 4 is fixed on the annular support 101 through pressure plate screws 6, the flexible sealing body lower pressure plate 5 is arranged at a lower end face of the flexible sealing body 3, and the flexible sealing body lower pressure plate 5 is fixed on an upper surface of the floating disc 2 through pressure plate screws 6. When the flexible sealing body 3 is installed in the storage tank, front and back surfaces of fixed positions of the flexible sealing body 3 must be coated with sealants, in order to guarantee that the flexible sealing body 3 in the tank body 1 can bear volatile oil gas with movable pressure and prevent leakage in the up-and-down motion process of the floating disc 2. The arrangement of the flexible sealing body 3 makes the space between the floating disc 2 and the inner wall of the tank body 1 totally enclosed by the flexible sealing body 3.

The bottom of the floating disc 2 is provided with inner support legs 202, the edge of the floating disc 2 is provided with an outer frame 201, and the edge of the outer frame 201 is provided with a plurality of sealing structures, which achieve the effect of closing leakage from the gap between the tank body and the floating disc. The plurality of closing structures may be a large compensation seal 204, a tongue type seal 203, a bag type seal and the like. The plurality of sealing structures in the present embodiment is a tongue type seal 203 and a large compensation mechanical seal 204, the tongue type seal 203 is arranged above the large compensation mechanical seal 204, and the tongue type seal 203 and the large compensation mechanical seal 204 both abut against the inner wall of the tank body 1.

The pressure relief balance structure includes upper pressure relief pipe L joints 7, pressure relief corrugated pipes 9, lower pressure relief pipe L joints 8 and pressure relief pipe fixing clamps 10, the upper pressure relief pipe L joints 7 and the lower pressure relief pipe L joints 8 are communicated with the pressure relief corrugated pipes 9 through the pressure relief pipe fixing clamps 10, the pressure relief balance structure has an effect that oil gas stored in an upper airtight space (between the tank wall and the flexible sealing body 3) flows back into the storage tank through the pressure relief corrugated pipes 9, and in the up-and-down motion process of the floating disc 2, the pressure relief corrugated pipes 9 can be expanded and contracted from top to bottom and prevented from being pulled and fractured.

Specifically, the pressure relief corrugated pipes 9 adopt a corrugated pipe material having pressure resistance, chemical corrosion resistance, high temperature resistance and fire resistance. Specifically, the pressure relief corrugated pipes 9 are metal hoses, and may be spontaneously changed in expansion and contraction along with the lifting and descending of the floating disc 2. The pressure relief corrugated pipes 9 are distributed in the diameter direction of the tank body, and two or a plurality of pressure relief corrugated pipes are uniformly distributed. The upper pressure relief pipe L joints 7 and the lower pressure relief pipe L joints 8 are both formed by bending circular pipes by a pipe bending forming machine, one end of each pressure relief pipe L joint is welded with a connecting flange, the upper pressure relief pipe L joints are bent and formed according to the arc curvature of the annular support 101 fixed by the flexible sealing body 3 before welding the connecting flanges of the upper pressure relief pipe L joints, and two surfaces are completely attached, and the lower pressure relief pipe L joints 8 are bent and formed according to the arc curvature of the outer frame 201 before welding the connecting flanges of the lower pressure relief pipe L joints, and two surfaces are completely attached. The upper pressure relief pipe L joints 7 are connected with a side plate of the annular support 101 through the flange with the arc surface and the flexible sealing body 3, a sealing cushion is arranged between the flange and the annular support 101, a through hole is provided in the joint of the side plate of the annular support 101, the upper portions of the pressure relief corrugated pipes 9 are connected with the annular support 101 through the upper pressure relief pipe L joints 7 and penetrate through the inside, a sealing cushion is arranged between the lower pressure relief pipe L joints and the outer frame 201, and the lower portions of the pressure relief corrugated pipes 9 penetrate through the outer frame 201 through the lower pressure relief pipe L joints 8 and are communicated with hydraulic oil gas at the bottom of the floating disc 2.

The present invention further includes a unit for preventing the flexible sealing body in the tank body from being accumulated and folded, the unit for preventing the flexible sealing body in the tank body from being accumulated and folded is an elastic arc plate 11 that is made of a stainless steel plate, has good elasticity and is provided with an arc at the end portion, the elastic arc plate 11 is positioned between the inner wall of the tank body 1 and the flexible sealing body 3 and is fastened on the top of the outer frame 201 through pressure plate screws 6, and the elastic arc plate 11 abuts against the inner wall of the tank body 1. Specifically, the elastic arc plate 11 is made of 316 elastic stainless steel, the upper portion of the elastic arc plate is bent, the curvature of the elastic arc plate is equal to the inner arc surface of the tank body 1, and the elastic arc plate is tightly attached to the tank wall to lift and fall along with the floating disc. The elastic arc plate 11 is arranged to prevent the situation that the flexible sealing body 3 in the tank body is accumulated in a sealing area of the floating disc 2 due to the flexible property of cloth when the floating disc 2 descends, when the flexible sealing body 3 rises along with the floating disc 2, the part of the flexible sealing body 3 may be squeezed and torn to be damaged by the movement gap between the floating disc 2 and the seal, and thus the flexible sealing body 3 loses the function of closing the VOCs and preventing diffusion.

The present invention further includes a guide stand column 107, one end of the guide stand column 107 is arranged at the bottom of the tank body 1, the other end of the guide stand column 107 penetrates through the floating disc 2 and is fixed at the top of the tank body 1, and the guide stand column 107 is in sliding and sealing contact with the floating disc 2. The arrangement of the guide stand column 107 can play a good limiting role and avoid the rotation of the floating disc 2 in the tank body 1.

The working principle of the present invention is as follows: when hydraulic oil gas enters and exits the tank body 1, the volume of the hydraulic oil gas in the tank body 1 is changed, such that the storage liquid level is changed, the floating disc 2 in the tank body 1 floats up and down, in the floating process, the hydraulic oil gas has the condition of wall hanging, and thus part of the hydraulic oil gas leaks to the upper portion of the floating disc 2, at the moment, the volatile oil gas is stored between the tank body 1 and the flexible sealing body 3 due to the existence of the flexible sealing body 3, when the pressure borne by the flexible sealing body 3 is increased to a certain degree along with time and motion, the volatile oil gas at the moment may be squeezed by the flexible sealing body 3, and the volatile gas is returned to the lower portion of the floating disc 2 in the tank body 1 through the pressure relief corrugated pipes 9.

The above description is only preferred embodiments of the present invention, and is not intended to limit the technical scope of the present invention. As such, any minor amendments, equivalent changes and modifications made to the above embodiments according to the technical spirit of the present invention shall fall within the scope of the technical solution of the present invention.

The invention claimed is:

1. A storage tank inner wall and floating disc totally enclosed apparatus, comprising:

a tank body, a floating disc, a pressure relief balance structure, and a flexible sealing body structure, wherein the floating disc is arranged in the tank body, an edge of the floating disc is provided with an outer frame, the outer frame is provided with a plurality of sealing structures, a top of an inner wall of the tank body is provided with an annular support, the annular support has a cross section in a right-angled-n shape and a hollowed-out bottom, one end of the flexible sealing body structure is fixedly connected with the annular support, an other end of the flexible sealing body structure is fixedly connected with the outer frame, one end of the pressure relief balance structure is sequentially and fixedly connected with the flexible sealing body structure and the annular support, a joint of the annular support is provided with a through hole, the pressure relief balance structure is communicated with the annular support, an other end of the pressure relief balance structure is fixedly connected with the outer frame, the outer frame is correspondingly provided with an exhaust hole, and the exhaust hole is arranged below the plurality of sealing structures.

2. The storage tank inner wall and floating disc totally enclosed apparatus according to claim 1, wherein the flexible sealing body structure comprises a flexible sealing body, a flexible sealing body upper pressure plate, a flexible sealing body lower pressure plate and pressure plate screws, the flexible sealing body encircles in a barrel shape in a storage tank, upper and lower edge parts of the flexible sealing body are provided with fixed hole sites, the flexible sealing body upper pressure plate is arranged at an upper end of the flexible sealing body in a covering mode, the flexible sealing body upper pressure plate is fixed on the annular support through pressure plate screws, the flexible sealing body lower pressure plate is arranged at a fixed position of a lower end of the flexible sealing body, and the flexible sealing body lower pressure plate is fixed on an upper surface of the floating disc through pressure plate screws.

3. The storage tank inner wall and floating disc totally enclosed apparatus according to claim 2, wherein front and back surfaces of upper and lower fixed positions of the flexible sealing body are coated with sealants or additionally provided with sealing strips.

4. The storage tank inner wall and floating disc totally enclosed apparatus according to claim 1, wherein the pressure relief balance structure further comprises an upper pressure relief pipe L joint, a pressure relief corrugated pipe, a lower pressure relief pipe L joint and pressure relief pipe fixing clamps, the upper pressure relief pipe L joint is fixed on a side plate of the annular support, the upper pressure relief pipe L joint is communicated with the through hole, the lower pressure relief pipe L joint is fixed on the outer frame and communicated with the exhaust hole, and the upper pressure relief pipe L joint and the lower pressure relief pipe L joint are communicated with the pressure relief corrugated pipe through the pressure relief pipe fixing clamps.

5. The storage tank inner wall and floating disc totally enclosed apparatus according to claim 1, further comprising a sealing gasket, wherein the sealing gasket is arranged between the annular support and the inner wall of the tank body.

6. The storage tank inner wall and floating disc totally enclosed apparatus according to claim 1, wherein the plurality of sealing structures comprise a tongue type seal and a large compensation mechanical seal, the tongue type seal and the large compensation mechanical seal are both arranged on the outer frame of the floating disc, the tongue type seal is arranged above the large compensation mechanical seal, and the tongue type seal and the large compensation mechanical seal both abut against the inner wall of the tank body.

7. The storage tank inner wall and floating disc totally enclosed apparatus according to claim 2, further comprising an elastic arc plate, wherein an upper portion of the elastic arc plate is bent, a curvature of the elastic arc plate is the same as that of an arc surface inside the tank body, the elastic arc plate is located between the inner wall of the tank body and the flexible sealing body, the elastic arc plate is fixed on the outer frame of the floating disc, and the elastic arc plate abuts against the inner wall of the tank body.

8. The storage tank inner wall and floating disc totally enclosed apparatus according to claim 1, further comprising a guide stand column, wherein one end of the guide stand column is arranged at a bottom of the tank body, an other end of the guide stand column penetrates through the floating disc and is fixed at a top of the tank body, and the guide stand column is in sliding and sealing contact with the floating disc.

9. The storage tank inner wall and floating disc totally enclosed apparatus according to claim 1, wherein inner support legs are arranged at a bottom end face of the floating disc.

* * * * *